United States Patent [19]

Peterson

[11] 4,010,572

[45] Mar. 8, 1977

[54] DOOR CLOSER HAVING MEANS TO NEUTRALIZE THE DOOR CLOSING FORCE EXERTED THEREBY

[75] Inventor: Francis C. Peterson, St. Louis County, Mo.

[73] Assignee: C. Hager & Sons Hinge Manufacturing Company, St. Louis, Mo.

[22] Filed: June 2, 1975

[21] Appl. No.: 582,663

[52] U.S. Cl. ..... 49/386; 16/62; 16/137; 16/DIG. 10

[51] Int. Cl.[2] ..... E05F 15/04; E05F 3/22

[58] Field of Search ..... 16/69, 137, DIG. 9, 16/62; 49/137, 265, 273, 274, 341, 386

[56] References Cited

UNITED STATES PATENTS

| | | | |
|---|---|---|---|
| 2,276,338 | 3/1942 | Potter et al. | 49/137 |
| 2,298,542 | 10/1942 | Potter et al. | 49/137 |
| 2,586,442 | 2/1952 | Seagren | 49/137 |
| 2,618,365 | 11/1952 | Seagren | 49/137 |
| 3,872,541 | 3/1975 | Peterson | 16/137 |

*Primary Examiner*—Werner H. Schroeder
*Assistant Examiner*—Conrad L. Berman
*Attorney, Agent, or Firm*—Gravely, Lieder & Woodruff

[57] ABSTRACT

A door closer has an air cylinder which, when pressurized, neutralizes the door closing force applied by the closer so that the door will open with relative ease. The air cylinder is pressurized through a valve which is contained within the door and is operated by a handle on the door.

16 Claims, 3 Drawing Figures

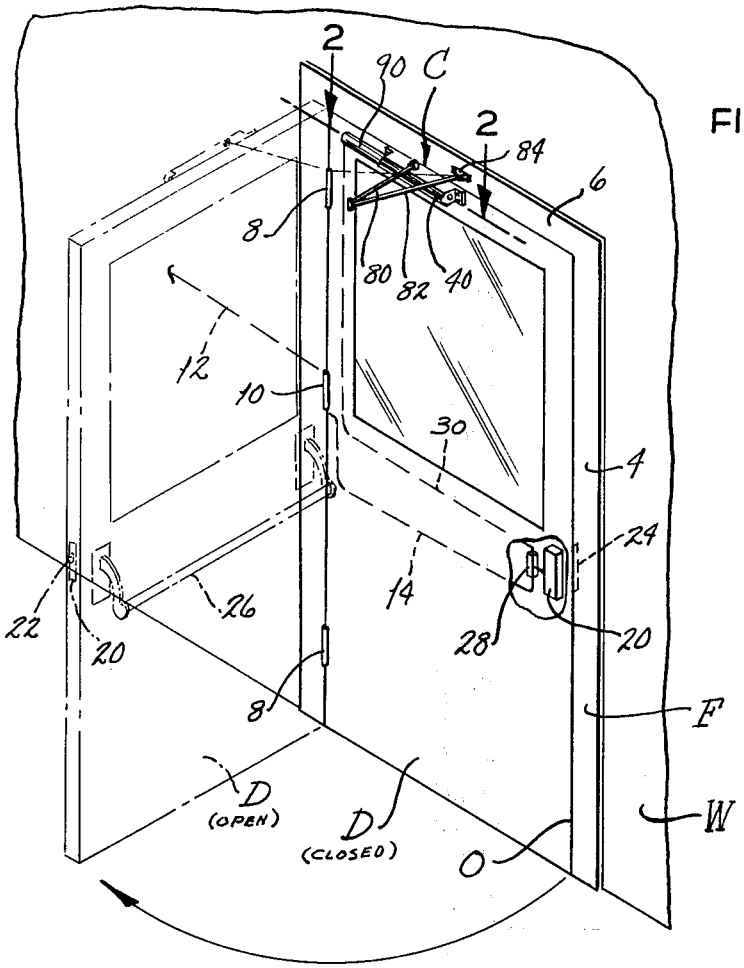
FIG. 1
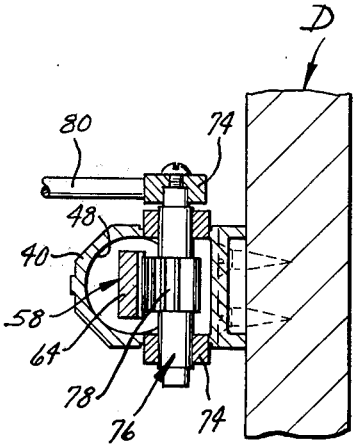
FIG. 3
FIG. 2
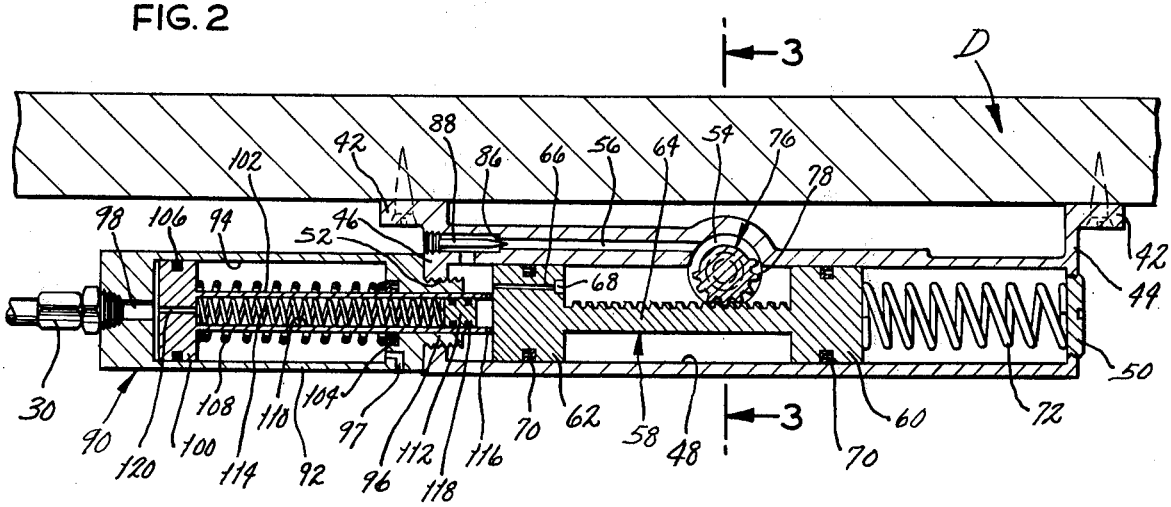

DOOR CLOSER HAVING MEANS TO NEUTRALIZE THE DOOR CLOSING FORCE EXERTED THEREBY

BACKGROUND OF THE INVENTION

This invention relates in general to doors and more particularly to devices for closing doors once they are opened.

The typical door closer exerts a closing force on the door to which it is attached so that whenever the door is opened and thereafter released, the door will return to its closed position. The closing force is derived from a relatively strong spring within the device, and to prevent the spring from closing the door too quickly, most door closers are further provided with a damper in the form of a dashpot. The spring is always stressed so that the closing force is exerted on the door, even when the door is closed. This spring force must, of course, be overcome before the door opens, and due to the large magnitude of the force, children, elderly people, and the infirm often have great difficulty opening doors provided with door closers, particularly where the doors are heavy and necessitate heavy door closers to maintain them closed.

SUMMARY OF THE INVENTION

One of the principal objects of the present invention is to provide a door closer which exerts little if any force on the door which carries it as the door is being opened, but exerts the normal closing force as the door closes and while the door is in its closed position. Another object is to provide a door closer with a pneumatically operated assist to generally neutralize the force of the spring within the closer while the door is being opened. An additional object is to provide a conventional door closer with means for neutralizing it as the door is being opened. These and other objects and advantages will become apparent hereinafter.

The present invention is embodied in a combination including means for exerting a closing force on a door and means for neutralizing said first mentioned means as the door is opened so that the door may be opened with relative ease. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur:

FIG. 1 is a perspective view of a door provided with the door closer of the present invention;

FIG. 2 is a longitudinal sectional view of the door closer when the door is in its closed position; and FIG. 3 is a sectional view taken along line 3—3 of FIG. 2.

DETAILED DESCRIPTION

Referring now to the drawings (FIG. 1), a wall W contains a door frame F which delineates a door opening O therein. The door frame F supports a door D which is normally in a closed position and when so disposed blocks the opening O. The door D is normally urged to its closed position by a door closer C which is carried on the door D and is connected with the door frame F. The door frame F and the door D constitute an entry structure, and the door closer C is connected between these components of the entry structure.

The door frame F includes (FIG. 1) a hinge jamb 2, a strike jamb 4, and a header 6 extended between the upper ends of the two jambs 2 and 4. The door D is supported on the hinge jamb by a pair of conventional full mortise hinges 8 and also by a so-called air hinge 10. The air hinge 10 is a full mortise hinge of the loose joint variety, and has one of its leaves secured to the hinge jamb 2 and the other of its leaves secured to the side edge of the door D. The major difference between the hinge 10 and the hinges 8 is that the former possesses the capability of transmitting pressurized air through it, that is from one leaf to the other, irrespective of the angular positions of the leaves. Moreover, the wall W contains an air line 12 which leads from a source of pressurized air and is connected to that leaf of the hinge 10 which is secured to the hinge jamb 2. The door D on the other hand contains an air line 14 which is connected to that leaf secured to the door D. The two air lines 12 and 14 are in communication through the hinge 10. A hinge suitable for use as the air hinge 10 is disclosed in U.S. Pat. No. 3,872,541. The air line 12 should contain a pressure regulator for varying the pressure of the air introduced into the door D.

The door D has a lock 20 (FIG. 1) including a latch bolt 22 which normally projects from the other side edge of the door D and into a keeper or strike 24 on the strike jamb 4. This secures the door D in its closed position. The lock 20 also includes an operating handle 26 which is presented on that side of the door D facing away from the direction in which the door D opens. Thus, if the door D opens outwardly, the handle 26 will be on the inside face. The handle 26 is spring loaded such that it is urged upwardly and away from the door D, and when the handle 26 is depressed toward the door D, it retracts the latch bolt 22 from the strike 24, freeing the door D so that it may be opened. The handle 26 also operates an air valve 28 which is contained with the door D and is connected to the other end of the air line 14, that is, the end opposite from that which is connected to the hinge 10. The door D contains another air line 30 which leads from the air valve 28 to the door closer C. When the handle 26 is depressed, the valve 28 opens and directs pressurized air to the closer C through the air line 30. When the handle 26 is elevated by its biasing spring, the valve 28 closes and vents the air line 30. The lock 20 may also be provided with a thumb piece or knob on the outside surface of the door for also retracting the latch bolt. The thumb piece or knob may or may not operate the air valve 28.

The door closer C is mounted on the face of the door D which is presented in the direction in which the door D is opened, that is, on the other side from the handle 26. It is moreover located close to the upper edge and near the hinge jamb 2.

The door closer C includes (FIG. 2) a cast metal housing 40 which is elongated and has mounting tabs 42 projecting from its ends. These tabs 42 receive screws or bolts which secure the housing 40 firmly to the door D. The housing 40 has end walls 44 and 46, and between those end walls it is provided with a bore 48, the axis of which is horizontal and parallel to the plane of the door D. That end of the bore 48 which is at the end wall 44 is closed by a plug 50 which threads into the end wall 44. The other end wall 48 has a threaded port 52 which opens into the bore 48 and is coaxial with the bore 48. Intersecting the horizontal bore 48, is a vertical bore 54 which is located about midway between the end walls 44 and 46 and has its axis slightly offset from the axis of the horizontal bore 48. Extended between the vertical bore 54 and that end of the horizontal bore 48 which is located at the end wall 46 is a bypass channel 56.

The horizontal bore 48 contains a shiftable element or spool 58 including a pair of pistons 60 and 62 which are always located on opposite sides of the vertical bore 54 and are connected by a rack 64. The piston 62 has an axial flow channel 66 which contains a check valve 68. The check valve 68 is oriented such that fluid flows easily through the channel 66 in the direction of the end wall 46, but not in the direction of the end wall 44. The pistons 60 and 62 also have seal rings 70 which wipe the surface of the bore 48. The spool 58 is urged toward the end wall 46 by a return spring 72 of the coil type which is also contained within the bore 48, it being located between the threaded plug 50 and the piston 60.

The vertical bore 54 contains sleeve bearings 74 (FIG. 3) which thread into its ends, and a spindle 76 is received within the bearings 74. The spindle 76 extends completely through the bore 54, and its ends, which are square, are exposed at the exterior of the cast housing 40. Midway between its ends, the spingle 76 has a gear segment 78, the teeth of which mesh with the teeth on the rack 64. Thus, when the spindle 76 rotates, it will move the spool 58 through the horizontal bore 48, enabling the spool 58 to compress the spring 72. Likewise, when the spring 72 moves the spool 58, the spindle 76 will rotate in the opposite direction.

The square upper end of the spindle 76 has a lever arm 80 (FIG. 1) attached firmly to it, and when the door D is closed, this arm projects away from the face of the door D at almost a right angle. The far end of the lever arm 80 is pivotaly connected to a connecting link 82 which in turn is pivotally connected to a bracket 84 secured to the header 6 of the door frame F. The lever arm 80 and the connecting link 82 constitute a linkage arrangement which rotates the spindle 76 as the door D moves.

The bypass channel 56 (FIG. 2) contains an orifice 86 into which a tapered needle 88 projects, and the needle 88 varies the effective cross sectional area of the orifice 86 when turned. The needle 88 is adjustable from the end wall 46.

The horizontal bore 48, the vertical bore 54 and the bypass channel 56 are all filled with a suitable damping fluid such as oil. When the door D opens and the spool 58 moves toward the end wall 44, this fluid flows easily through the axial flow channels 66 in the pistons 60 and 62, since the check valve 68 permits oil to flow toward the end wall 46. However, when the door D closes, the spool 58 moves in the opposite direction, that is, toward the end wall 46, and the check valve 68 blocks the axial flow channel 66 through the piston 62. As a result, the oil between the piston 62 and the end wall 46 is forced through the bypass channel 56, and since the channel 66 contains a restriction, that is, the orifice 86, the flow is quite slow. Therefore, the door D closes slowly under the force exerted by the spring 72.

The spring 72 exerts a substantial force on the spool 58 and this force is utilized to return the door D to its closed position wherever it is opened. The force further serves to maintain the door D in its closed position. Thus, to open the door D, the force exerted by the spring 72 must be overcome. In conventional door closers the individual utilizing the door D supplies the force necessary to overcome the return spring. The door closer C, however, is provided with neutralizing means in the form of an air cylinder 90 which neutralizes the force exerted by the return spring 72 while the door D is being opened so that very little force need be applied to the door to open it.

The air cylinder 90 includes (FIG. 2) a barrel 92 containing a cylinder bore 94. One end of the barrel 92 is provided with a threaded nipple 96 which threads into the threaded port 52 in the end wall 46 of the cast housing 40 so as to secure the cylinder 90 firmly to the housing 40. This end of the barrel also has a vent 97 which vents the corresponding end of the bore 94. The opposite end of the barrel 92 has a threaded port 98 which opens into the cylinder bore 94, and this port is connected to the air line 30 leading from the air valve 28. Thus, when the handle 26 is depressed and the valve 28 opened, pressurized air will be admitted to the rear end of the bore 94, that is, the end into which the port 98 opens.

The barrel 92 contains a piston 100 which fits into the bore 94 thereof. The piston 100 carries a piston rod 102 which projects axially therefrom and extends through the threaded nipple 96 and into the horizontal bore 48 of the cast housing 40 where it bears against the end of the piston 62 on the spool 58. It is not, however, connected directly to the spool 58. The barrel 92 at the end thereof located adjacent to the housing 40 is provided with elastomeric seal rings 104 which prevent the oil in the bore 48 of the housing 40 from entering the bore 94 of the air cylinder 90. Likewise, the piston 100 is provided with a seal ring 106 which wipes the surface of the cylinder bore 94 and prevents pressurized air from passing by the piston 100. The piston 100 is urged toward the port 98 by a coil-type compression spring 108 which encircles the piston rod 102.

The piston rod 102 is hollow in that it has an axial bore 110 which extends the entire length thereof, and this bore contains a small floating piston 112 and a biasing spring 114 which is disposed between the two pistons 100 and 112 so as to urge the piston 112 toward the spool 58 when compressed. The portion of the piston rod 102 which is located adjacent to the spool 58 is provided with small apertures 116 which provide communication between the bore 48 of the housing and the bore 110 of the piston rod 102, and this of course enables the damping oil to enter the portion of the bore 110 located ahead of the piston 112. This oil bears against and moves the floating piston 112. The piston 112 carries seal rings 118 which wipe the surface of the bore 110 and prevent oil from passing into the portion of the bore 110 occupied by the spring 114. Air located within the piston rod 102 behind the piston 112 is expelled through a bleed hole 120 in the main piston 100 as the floating piston 112 moves.

OPERATION

The door D is normally in its closed position, and indeed is maintained in that position by the door closer C. More specifically, the return spring 72 bears against the spool 58 and in so doing applies a torque to the spindle 76 since the two are connected at the rack 64 and gear segment 78. The lever arm 80 and connecting link 82 convert this torque into a force which urges the door D snugly against the door frame F. When the door D is closed the piston 62 on the spool 58 is located close to the end wall 46 of the housing 40, while the piston 100 of the air cylinder 90 is located close to the rear end of the barrel 92, that is, near the port 48 (as illustrated in FIG. 2).

To open the door D, one merely depresses the handle 26 of the lock 20 downwardly and through the handle 26 applies a slight outwardly directed force to the door D. The movement of the handle 26 not only retracts the latch bolt 22 from the strike 24, but further opens the air valve 28 so that pressurized air is admitted to the air line 30 and also to the air cylinder 90 at port 98 therein. The increase in air pressure within the bore 94 of the cylinder barrel 92 exerts a force on the piston 100 and this force is transmitted through the piston rod 102 to the spool 58. The force exerted on the spool 58 by the piston 100 should just about equal the force exerted on the spool 58 by the return spring 72. In other words, the air cylinder 90 neutralizes the spring 72, and enables the spool 58 to move through the horizontal bore 48 of the cast housing 40 with little resistance. Consequently, the door D opens with relative ease as long as the handle 26 remains depressed.

As the door D opens, the spool 58 moves through the horizontal bore 48, toward the end wall 44, it being propelled by the spindle 76. The damping oil within the bore does not offer much resistance to this motion since the oil flows through the axial flow channel 66 in the piston 62. The return spring 72 is, of course, compressed, and the piston rod 102 enters the bore 48, maintaining contact with the end of the piston 62 of the spindle 58. The damping oil which is displaced by the piston rod 102 as it moves through the bore 48 passes through the apertures 116 and into the interior of the piston rod 102 where it exerts a force on the piston 112 located within the rod 102. The piston 112 in turn compresses the spring 114.

While the air cylinder 90 serves to neutralize the return spring 72, the former exerts a constant force, whereas the latter exerts a progressively greater force as it is compressed. Thus, the air cylinder 90 will completely or totally neutralize the return spring 72, only at one position for the door D, and that position depends on the pressure of the air supplied to the air line 12. Beyond that position the return force of the spring 72 will overcome the neutralizing force of the cylinder 90, and the user of the door will have to supply the additional force, which is very small in magnitude. It is desirable to have the return spring 72 completely neutralized when the door is at about 90°. Up to that position, a slight opening force must be applied to the door D by the user, and that force is applied through the depressed handle 26.

Once the handle 26 is released, the air valve 28 closes and blocks the supply of pressurized air to the air cylinder 90. The valve 28 further vents the portion of the air cylinder bore 94 behind the piston 100 so that the compression spring 108 will move the piston 100 back to its initial position near the port 98. This return spring 72, on the other hand, forces the spool 58 toward the end wall 46 and air cylinder 90, and further rotates the spindle 76. The torque applied to the spindle 76 is converted by the lever arm 80 and connecting link 82 into a force which urges the door D toward the opening O in the door frame F.

As the spool 58 moves through the bore 48 toward its initial position, the damping oil between the piston 62 and the end wall 46 is forced into the bypass channel 56 and through the orifice 86 therein. As a result, the spool 58 moves relatively slowly, notwithstanding the large force exerted by the return spring 72. Hence, the door D returns slowly to its closed position. The spring 114 within the piston rod 102 also expands, the acting through the floating piston 112 forces damping oil out of the bore 110 within the piston rod 102 so that the bore 110 will be capable of again accommodating displaced oil when the door D is next opened.

This invention is intended to cover all changes and modifications of the example of the invention herein chosen for purposes of the disclosure which do not constitute departures from the spirit and scope of the invention.

What is claimed is:

1. In combination with a door which moves between open and closed positions with respect to a door opening in a wall, the improvement comprising: force means for providing a restoring force when the door is opened; transfer means between the force means and the door for causing the restoring force to urge the door to its closed position; neutralizing means for at least in part neutralizing the force exerted by the force means when the door is opened by an individual desiring to pass through the door opening, the neutralizing means being an air cylinder including a barrel and a piston rod which moves relative to the barrel when the barrel is pressurized and which exerts a neutralizing force on the transfer means in opposition to the force exerted by the force means; and a valve carried by the door and connected between the air cylinder and a source of pressurized air for admitting the air to the air cylinder when activated.

2. The combination according to claim 1 and further comprising a handle carried by the door and movable toward the door; and wherein the valve is operated by the handle, the valve being opened when the handle is moved toward the door.

3. The combination according to claim 2 wherein the door opening is surrounded by a door frame; and wherein the door has latch bolt which normally projects beyond the door and engages the door frame to hold the door in its closed position, the latch bolt being connected to the handle such that it is retracted from the door frame when the handle is moved toward the door.

4. In combination with a door which moves between open and closed positions with respect to a door opening in a wall, the improvement comprising: force means for providing a restoring force when the door is opened, the force means including a spring; transfer means between the force means and the door for causing the restoring force to urge the door to its closed position, the transfer means comprising an element which undergoes linear movement as the door opens and closes, the element being acted upon and urged in one direction by the spring, the element being moved in the opposite direction by the door as the door opens; and neutralizing means for at least in part neutralizing the force exerted by the force means when the door is opened by an individual desiring to pass through the door opening, the neutralizing means being an air cylinder including a barrel and a piston rod which moves relative to the barrel and when the barrel is pressurized applies a neutralizing force to the element of the transfer means in opposition to the force exerted on the element by the spring.

5. The combination according to claim 4 and further comprising a housing having a bore and bypass channel therein, the element being within the bore and including a piston which moves within the bore, contacting the surfaces of the bore as it does, the bypass channel communicating with the bore beyond both ends of the piston and having a restriction therein; and wherein the bore and bypass channel are filled with a damping liquid which is forced through the bypass channel when the piston moves in the direction of the force exerted thereon by the spring.

6. The combination according to claim 5 wherein the shiftable element has a rack therein and the transfer means further comprises a spindle in the housing and having gear teeth engaged with the rack so that when the rack shifts the spindle will rotate and vice-versa, and linkage means between the spindle and the wall for causing the spindle to rotate as the door opens and closes.

7. The combination according to claim 1 wherein the piston rod extends into the bore of the housing and bears against the element therein to exert a force on the element in opposition to the force exerted by the spring.

8. The combination according to claim 7 wherein the piston rod is hollow and its hollow interior communicates with the bore of the housing so that the damping liquid which is displaced by the piston rod as it moves into the bore will flow into the hollow interior of the piston rod.

9. The combination according to claim 7 wherein the piston rod contains an axially extending bore which is in communication with the bore of the housing; and wherein the bore of the piston rod contains a floating piston and a spring which urges the floating piston toward that end of the piston rod which is projected into the bore.

10. In combination with a door which is mounted on hinges in a door opening within a wall and swings between open and closed positions with respect to the door opening, the improvement comprising a housing mounted on the door and containing a bore, a piston within the bore, a damping liquid in the bore, means associated with the piston to enable the piston to move rapidly through the bore in one axial direction and slowly in the other axial direction, force means for urging the piston in the direction in which it moves relatively slowly through the bore and for further exerting a closure force on the door, an air cylinder carried by the housing and including a piston rod which projects into the bore and when energized exerts a neutralizing force on the piston in opposition to the force exerted thereon by the force means, and a valve connected between the air cylinder and a source of pressurized air for admitting pressurized air to the air cylinder when actuated, whereby the force exerted by the air cylinder will at least in part neutralize the force means and the door will open with relative ease.

11. The combination according to claim 10 wherein the piston rod is hollow and in communication with the bore of the housing to accommodate liquid displaced by the piston rod as it enters the bore.

12. The combination according to claim 10 wherein the force means is a spring located in the bore.

13. For use in connection with an entry structure including first and second components, the first component being a swinging door which moves between open and closed positions with respect to a door opening in the second component which is a door frame, an improved door closer connected between the two entry structure components to urge the door toward and maintain it in its closed position and to further enable the door to be opened with ease, said door closer comprising: a housing mounted rigidly on one of the components and having a cavity provided with first and second ends; a shiftable element in the cavity and being capable of moving therein generally toward the first end and away from the second end and vice versa; a rotating spindle in the housing and being engaged with the shiftable element such that the spindle rotates when the element moves in the cavity; and a linkage arrangement connected between the spindle and the other entry structure component such that the spindle will rotate on one direction and the shiftable element will move toward the first end of the cavity when the door is opened and the spindle will rotate in the opposite direction and the element will move toward the second end of the cavity when the door is closed; a spring in the housing and urging the element toward the second end of the cavity, whereby when the door is opened, the spring urges the door toward its closed position; a liquid in the cavity; means in the housing for permitting the liquid to escape slowly from the portion of the cavity between the element and the second end of the cavity so that the element moves slowly toward the second end of the cavity under the force exerted by the spring when the door is not otherwise restricted; and an air cylinder including a barrel mounted in a fixed position with respect to the housing, a piston in the barrel, and a piston rod attached to the piston and extended out of the barrel into the cavity of the housing through the second end of the cavity, the piston rod being oriented to exert a force on the element in opposition to the force exerted thereon by the spring when the barrel is pressurized behind the piston, whereby when the air cylinder is energized, the force of the spring will be partially neutralized, allowing the door to be opened with ease.

14. The structure according to claim 13 wherein the movement of the shiftable element in the housing is characterized by pure translation with respect to the housing.

15. The structure according to claim 13 wherein the piston rod is hollow with the hollow interior thereof communicating with the portion of the cavity between the element and the second end of the cavity so that liquid displaced by the piston rod as it enters the cavity will be accommodated in the hollow interior of the piston rod.

16. The structure according to claim 13 wherein the spring is in the cavity between the first end thereof and the end of the element which is presented toward that first end.

* * * * *